US009217946B1

(12) United States Patent
Okazaki

(10) Patent No.: US 9,217,946 B1
(45) Date of Patent: Dec. 22, 2015

(54) EXPOSURE APPARATUS, IMAGE FORMING APPARATUS AND METHOD OF MANUFACTURING EXPOSURE APPARATUS

(71) Applicant: FUJI XEROX CO., LTD., Tokyo (JP)

(72) Inventor: Sachiya Okazaki, Mie (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/511,349

(22) Filed: Oct. 10, 2014

(30) Foreign Application Priority Data

Jun. 20, 2014 (JP) ..... 2014-127335

(51) Int. Cl.

| | |
|---|---|
| ***B41J 2/435*** | (2006.01) |
| ***B41J 15/14*** | (2006.01) |
| ***B41J 27/00*** | (2006.01) |
| ***G03G 15/04*** | (2006.01) |

(52) U.S. Cl.
CPC ..... *G03G 15/04036* (2013.01)

(58) Field of Classification Search
CPC ..... B41J 2/447; B41J 2/45; B41J 2/451
USPC ..... 347/237, 238, 241, 242, 247, 256–258, 347/263
See application file for complete search history.

(56) References Cited

U.S. PATENT DOCUMENTS 8,345,074 B2 * 1/2013 Okazaki ..... 347/130

FOREIGN PATENT DOCUMENTS

| | | | | |
|---|---|---|---|---|
| JP | 2009096137 A | * | 5/2009 | ..... B41J 2/44 |
| JP | 2012-035476 | | 2/2012 | |
| JP | 2012-051250 | | 3/2012 | |

OTHER PUBLICATIONS

Abstract and machine translation of JP 2012-035476.
Abstract and machine translation of JP 2012-051250.

* cited by examiner

*Primary Examiner* — Hai C Pham
(74) *Attorney, Agent, or Firm* — Fildes & Outland, P.C.

(57) ABSTRACT

An exposure apparatus includes: a substrate that has a light emitting element mounted on a front surface of the substrate; a casing to which the substrate and an optical element are fixed so as to allow the substrate to face the optical element that focuses light emitted from the light emitting element; a sealing material that seals a fitting portion between the substrate and the casing from a rear surface side of the substrate; and a conductive component that is mounted on a ground terminal formed on the rear surface of the substrate and has a height from the rear surface higher than a height of the sealing material at an end portion on a central portion side of the substrate.

6 Claims, 7 Drawing Sheets

EXPOSURE APPARATUS, IMAGE FORMING APPARATUS AND METHOD OF MANUFACTURING EXPOSURE APPARATUS

CROSS-REFERENCE TO RELATED APPLICATIONS

This application is based on and claims priority under 35 USC 119 from Japanese Patent Application No. 2014-127335 filed on Jun. 20, 2014.

BACKGROUND

1. Technical Field

The present invention relates to an exposure apparatus, an image forming apparatus and a method of manufacturing an exposure apparatus.

SUMMARY

According to an aspect of the invention, there is provided an exposure apparatus including a substrate that has a light emitting element mounted on a front surface thereof, a casing to which the substrate and an optical element are fixed so as to allow the substrate to face the optical element that focuses light emitted from the light emitting element, a sealing material that seals a fitting portion between the substrate and the casing from a rear surface side of the substrate, and a conductive component that is mounted on a ground terminal formed on the rear surface of the substrate and has a height from the rear surface higher than a height of the sealing material at an end portion on a central portion side of the substrate.

BRIEF DESCRIPTION OF THE DRAWINGS

Exemplary embodiments of the present invention will be described in detail based on the following figures, wherein.

DESCRIPTION OF REFERENCE NUMERALS AND SIGNS

Figure 1:
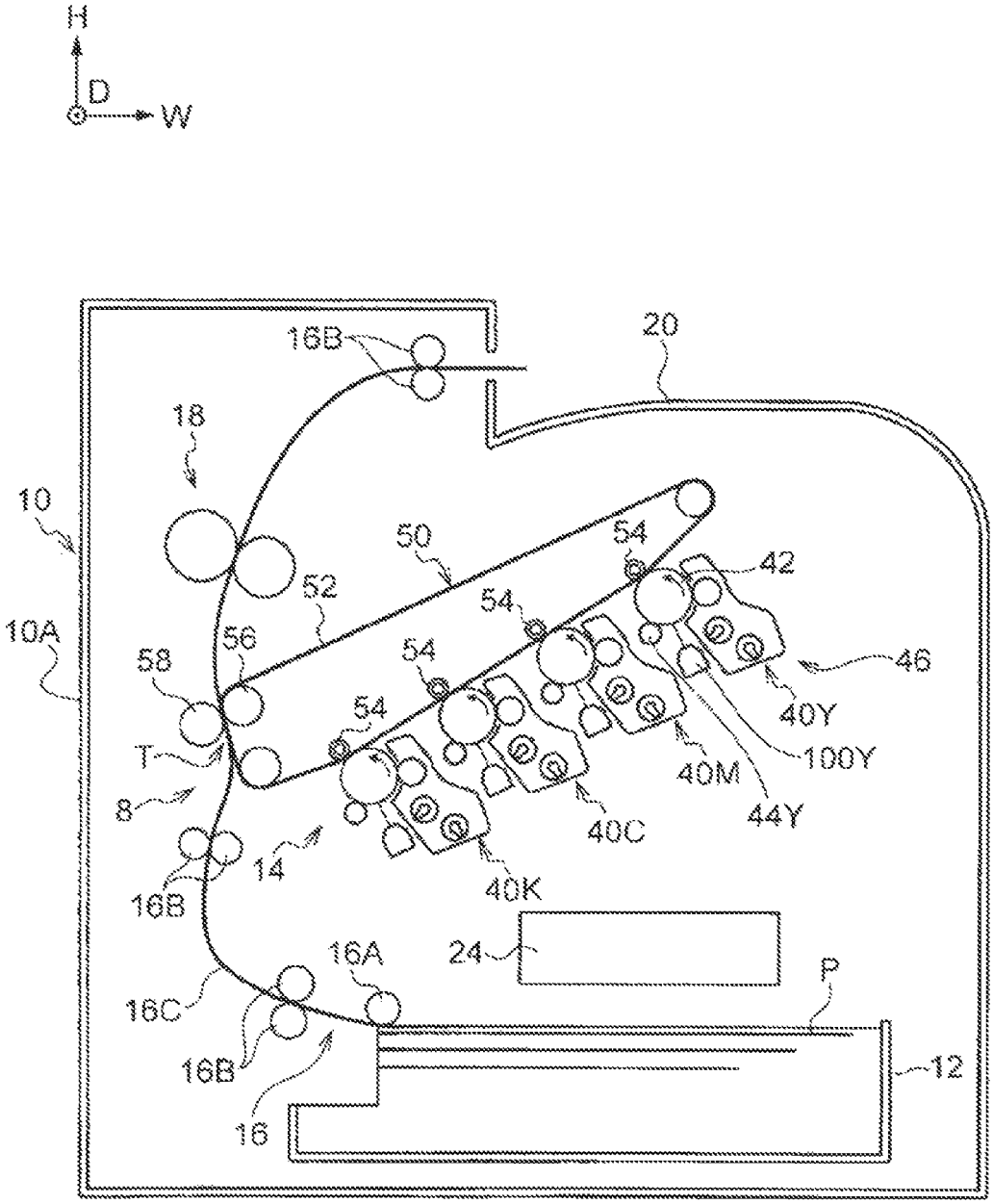
FIG. 1 is a schematic diagram (a front view) of an image forming apparatus according to an exemplary embodiment.

10 image forming apparatus
10A image forming apparatus main body
42 photoreceptor (example of image carrier)
44 electricity charging apparatus
46 development apparatus

50 transfer unit (example of transfer apparatus)
52 transfer belt (example of transfer object)
60 light emitting substrate (example of substrate)
62 LED array (example of light emitting element)
63 ground terminal
64 conductive component
70 lens array (example of optical element)
80 casing
90 sealing material
92 facing portion (example of fitting portion)
100 exposure apparatus
H1 height of conductive component from rear surface
H2 height of sealing material at end portion of substrate in short direction
H5 height of sealing material at end portion on central portion side of substrate
H6 height of sealing material at end portion on central portion side of substrate
P medium (example of transfer object)

DETAILED DESCRIPTION

Hereinafter, the present exemplary embodiment will be described with respect to the drawings. Initially, an overall configuration and an operation of an image forming apparatus will be described. Subsequently, an exposure apparatus which is a main part of the present exemplary embodiment and a method of manufacturing an exposure apparatus will be described. Subsequently, an operation of the present exemplary embodiment will be described. Subsequently, a modification example of the present exemplary embodiment will be described. In the following descriptions, a direction indicated by the arrow H in FIG. 1 is referred to as an apparatus height direction, and a direction indicated by the arrow W therein is referred to as an apparatus width direction. A direction (suitably, indicated by the arrow D) orthogonal to each of the apparatus height direction and the apparatus width direction is referred to as an apparatus depth direction.

<<Overall Configuration of Image Forming Apparatus>>

An image forming apparatus 10 is configured to include an image forming apparatus main body 10A, an image forming portion 8, and a control device 24. Hereinafter, descriptions will be given with reference to FIG. 1.

In the image forming apparatus 10 according to the present exemplary embodiment, each of portions forming the image forming portion 8 is configured to be detachable from the image forming apparatus 10. An image forming apparatus main body 10A denotes a portion which is configured to include a casing (a frame, not illustrated) of the image forming apparatus 10 and outer packaging, excluding the image forming portion 8 in the image forming apparatus 10.

[Image Forming Portion]

The image forming portion 8 includes a medium accommodation portion 12, a toner image forming portion 14, a transportation portion 16, a fixing device 16, and a discharge portion 20. The image forming portion 8 forms an image on a medium P. The control device 24 controls operations of each portion of the image forming apparatus 10. Here, the medium P is an example of a transfer object.

[Toner Image Forming Portion]

The toner image forming portion 14 includes image forming units 40Y, 40M, 40C, and 40K, and a transfer unit 50. Here, yellow (Y), magenta (M), cyan (C), and black (K) are examples of toner colors. The transfer unit 50 is an example of a transfer apparatus.

The image forming units 40Y, 40M, 40C, and 40K have substantially similar configurations to one another, other than toners to be used. In FIG. 1, the reference numeral and sign for each portion configuring the image forming units 40M, 40C, and 40K is omitted.

<Image Forming Unit>

The image forming unit 40Y includes a photoreceptor 42Y, an electricity charging apparatus 44Y, an exposure apparatus 100Y, and a development apparatus 46Y. Similarly, in order to correspond to each color, the image forming units 40M, 40C, and 40K respectively include photoreceptors 42M, 42C, and 42K; electricity charging apparatuses 44M, 44C, and 44K; exposure apparatuses 100M, 100C, and 100K; and development apparatuses 46M, 46C, and 46K. In the following descriptions, the reference index will be omitted when there is no need to distinguish the colors from one another in respect of the image forming units 40Y, 40M, 40C, and 40K and each member configuring thereof.

(Photoreceptor)

The photoreceptors 42 respectively function to hold toner images developed by the development apparatuses 46, while rotating around their own axes. Each of the photoreceptors 42 includes a base member and a photoreception layer which is formed on an outer peripheral surface of the base member. Here, the photoreceptor 42 is an example of an image carrier.

(Electricity Charging Apparatus)

The electricity charging apparatuses 44 respectively function to electrically charge the photoreceptors 42.

(Exposure Apparatus)

The exposure apparatuses 100 respectively function to form latent images on the electrically charged photoreceptors 42. In each of the exposure apparatuses 100, the below-described conductive component 64 is grounded to the casing of the image forming apparatus main body 10A. The exposure apparatus 100 will be described later on account of being a main portion of the present exemplary embodiment.

(Development Apparatus)

The development apparatuses 46 respectively function to develop the latent images formed on the photoreceptors 42 into the toner images.

<Transfer Unit>

The transfer unit 50 functions to secondarily transfer the toner image onto the medium P after the toner images in each color respectively developed in the photoreceptors 42 are primarily transferred. The transfer unit 50 includes a transfer belt 52, a plurality of primary transfer rolls 54, a drive roll 56, and a secondary transfer roll 58.

[Fixing Device]

The fixing device 18 heats and pressurizes the toner image secondarily transferred onto the medium P at a nipping portion so as to cause the toner image to be fixed to the medium P.

[Transportation Portion and Discharge Portion]

The transportation portion 16 functions to cause the medium P accommodated in the medium accommodation portion 12 to be transported through a transportation path 16C including a secondary transfer portion (a facing portion between the drive roll 56 and the secondary transfer roll 58) and the nipping portion of the fixing device 18, thereby discharging the medium P to the discharge portion 20. The transportation portion 16 includes a delivery roll 16A and a plurality of pairs of transportation rolls 16B.

[Supplement to Image Forming Apparatus]

The electricity charging apparatuses 44, the development apparatuses 46, and the primary transfer rolls 54 and the secondary transfer roll 58 included in the transfer unit 50 configuring the image forming apparatus 10 are respectively connected to high pressure power sources (not illustrated), thereby being applied with a voltage. In the image forming apparatus 10 of the present exemplary embodiment, the ground terminal of each high pressure power source and the base member of each photoreceptor 42 are grounded to the casing of the image forming apparatus main body 10A.

<Operation of Image Forming Apparatus>

Next, operations of the image forming apparatus 10 will be described with reference to FIG. 1.

An image signal transmitted from an external apparatus (for example, a PC) is converted into pieces of image data for each color by the control device 24, thereby being output to each of the exposure apparatuses 100.

Subsequently, exposure light emitted from each of the exposure apparatuses 100 is incident on each of the photoreceptors 42 electrically charged respectively by the electricity charging apparatuses 44, thereby forming the latent images. Subsequently, the latent images are respectively developed by the development apparatuses 46 as the toner images in each color. Subsequently, the toner images in each color are primarily transferred to the transfer belt 52 by each of the primary transfer rolls 54.

Meanwhile, the medium P is transported at timing when the primarily transferred portions of the toner images on the transfer belt 52 arrive at a nipping portion T, thereby being secondarily transferred.

Subsequently, the medium P to which the toner images are secondarily transferred is transported toward the fixing device 18, and the toner images are fixed to the medium P.

The medium P to which the toner images are fixed is discharged to the discharge portion 20, thereby completing the image forming operation.

<<Configuration of Main Portion (Exposure Apparatus)>>

Figure 2:
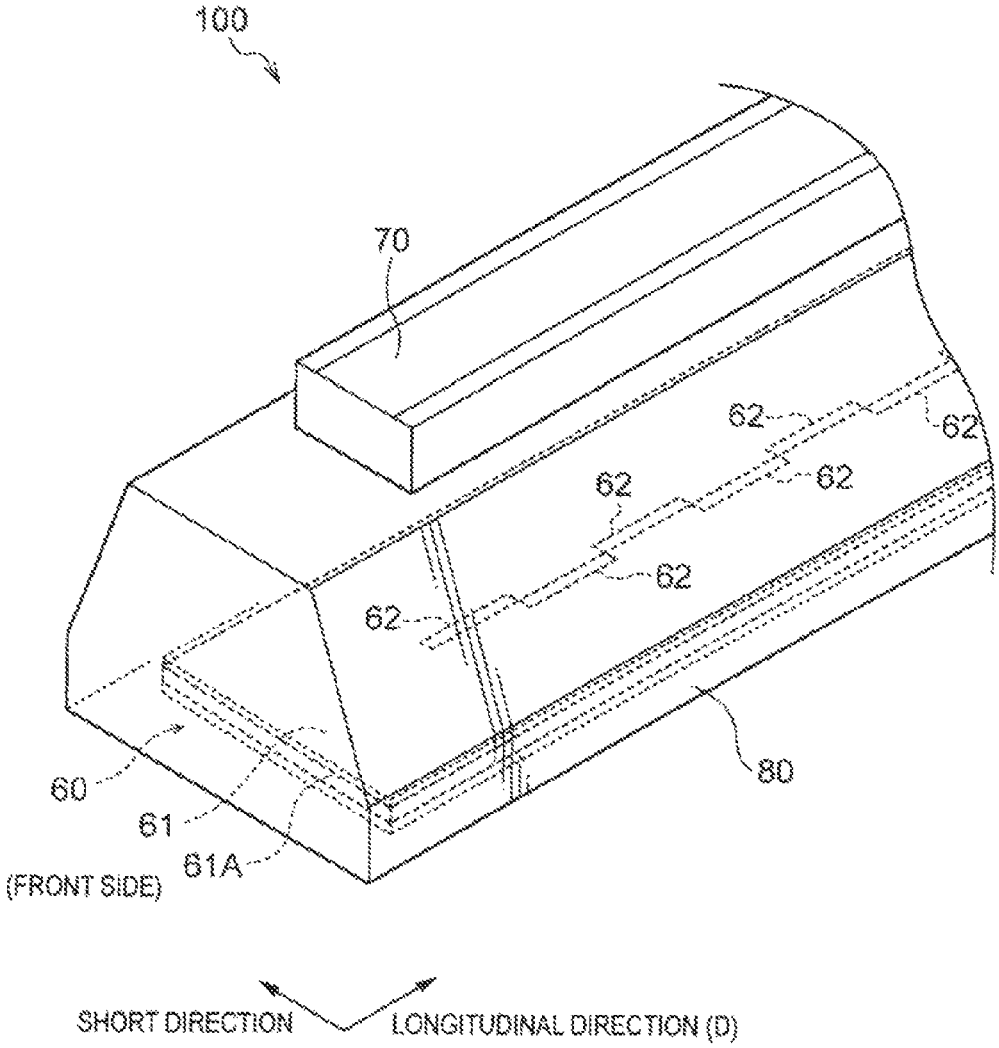
FIG. 2 is a perspective view illustrating a portion of an exposure apparatus configuring the image forming apparatus according to the exemplary embodiment.
Figure 4:
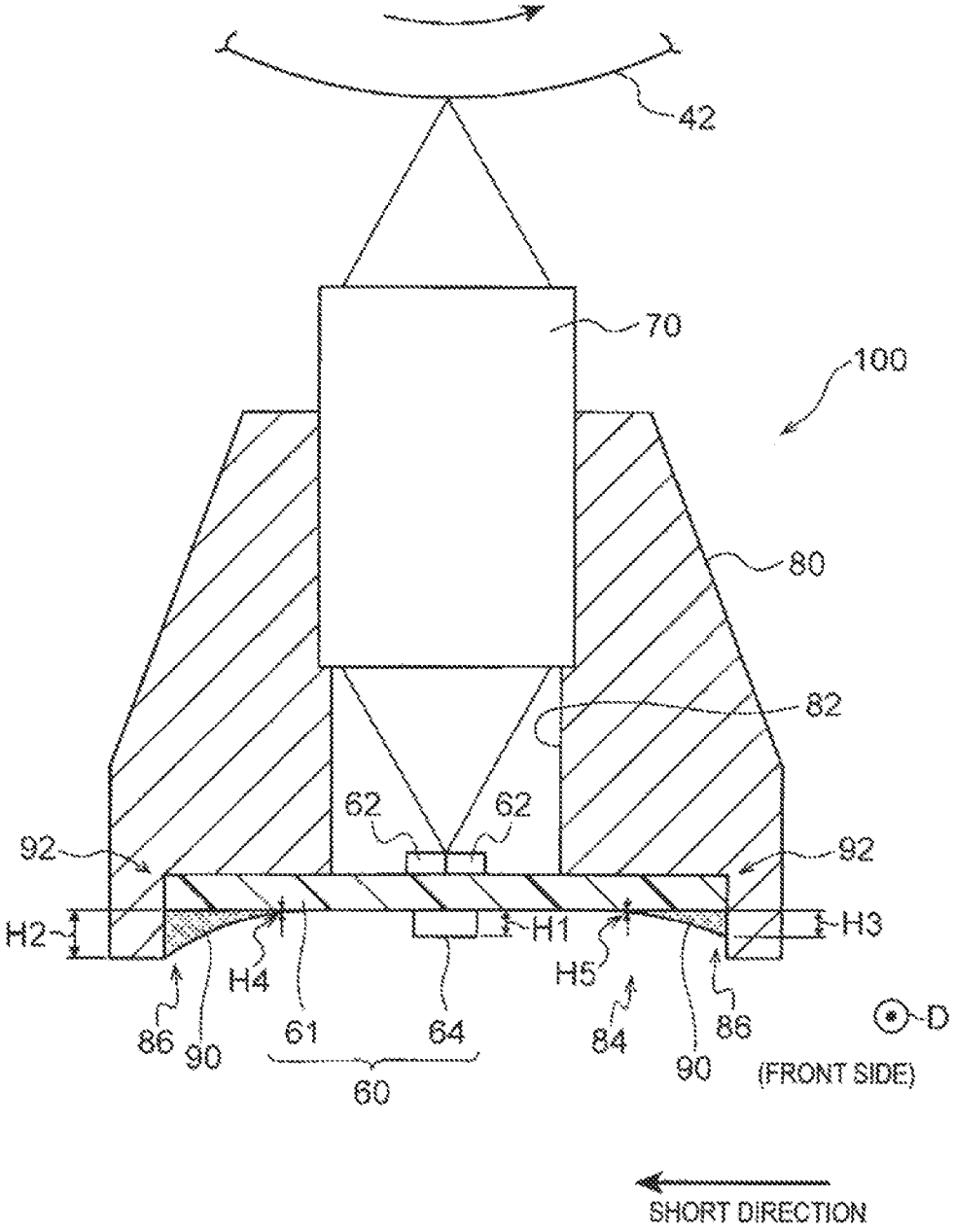
FIG. 4 is a schematic diagram (a front view) illustrating a relationship between the exposure apparatus and a photoreceptor configuring the image forming apparatus according to the exemplary embodiment.

Next, descriptions will be given regarding the exposure apparatus 100 which is a main portion of the present exemplary embodiment, with reference to the drawings. As illustrated in FIGS. 2 and 4, the exposure apparatus 100 is configured to include a light emitting substrate 60, a lens array 70, a casing 80, and a sealing material 90. Here, the lens array 70 is an example of an optical element. The exposure apparatus 100 is detachably attached to the image forming apparatus main body 10A.

[Light Emitting Substrate]

The light emitting substrate 60 functions to emit light from a plurality of LED arrays 62 described below toward the lens array 70, based on the image data converted by the control device 24. Here, the light emitting substrate 60 is an example of a substrate. The LED array 62 is an example of a light emitting element.

As illustrated in FIG. 4, the light emitting substrate 60 is configured to include a printed circuit board 61 (hereinafter, referred to as the substrate 61), the plurality of LED arrays 62, and the conductive component 64.

[Printed Circuit Board]

Figure 6:
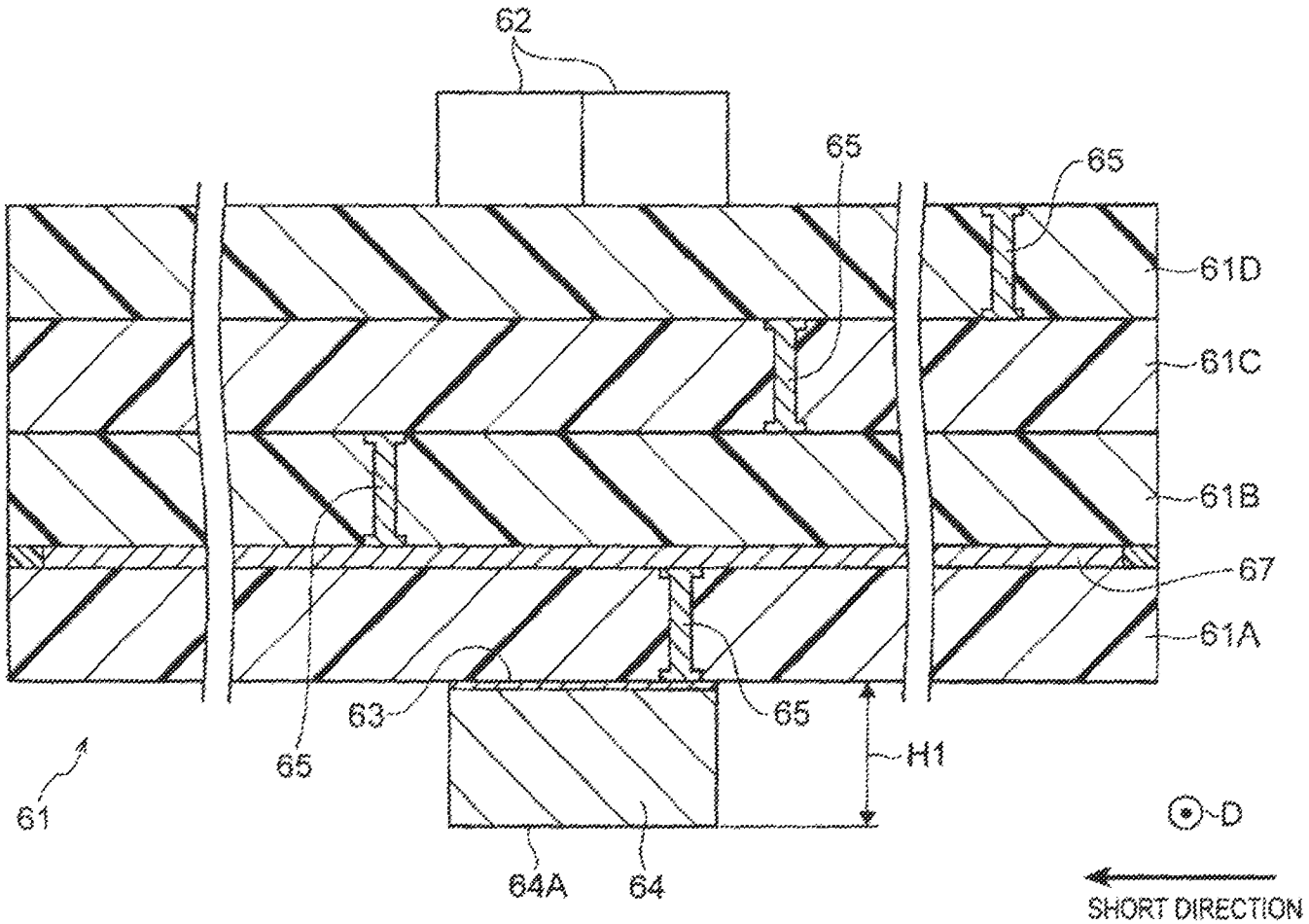
FIG. 6 is a cross-sectional diagram (a front view) of the light emitting substrate configuring the exposure apparatus according to the exemplary embodiment.

The substrate 61 is an elongated plate. As illustrated in FIG. 6, the substrate 61 is a so-called multi-layered substrate. In the present exemplary embodiment, the substrate 61 is a four-layered substrate, as an example. Substrates adjacent to each other among substrates 61A, 61B, 61C, and 61D configuring the four-layered substrate are connected to each other by a via 65. In FIG. 6, for convenience of description, thicknesses of the substrates 61A, 61B, 61C, and 61D and an elongated conductive layer 67 described below are illustrated to be different from the actual measurement ratio.

Figure 3:
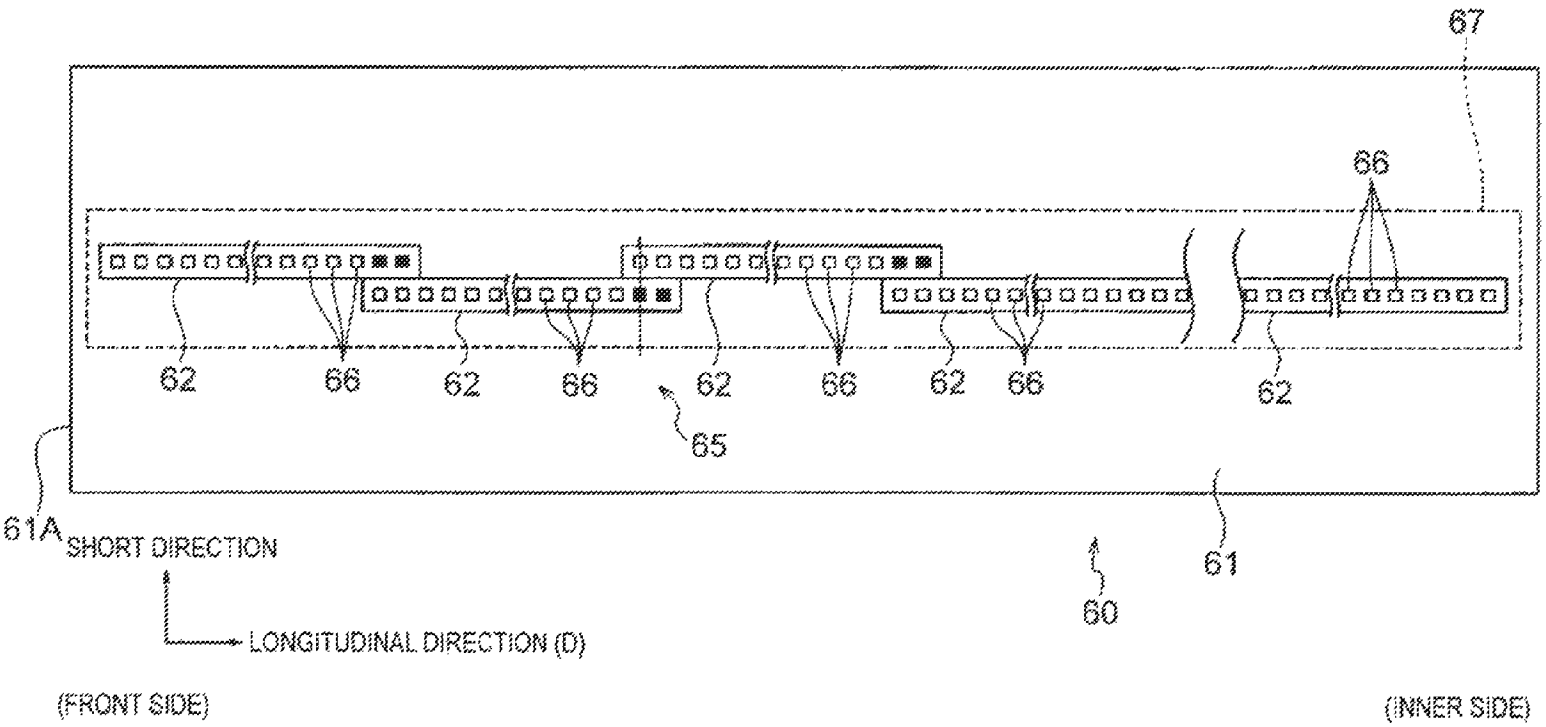
FIG. 3 is a schematic diagram (a top view) of a light emitting substrate configuring the exposure apparatus according to the exemplary embodiment.
Figure 7:
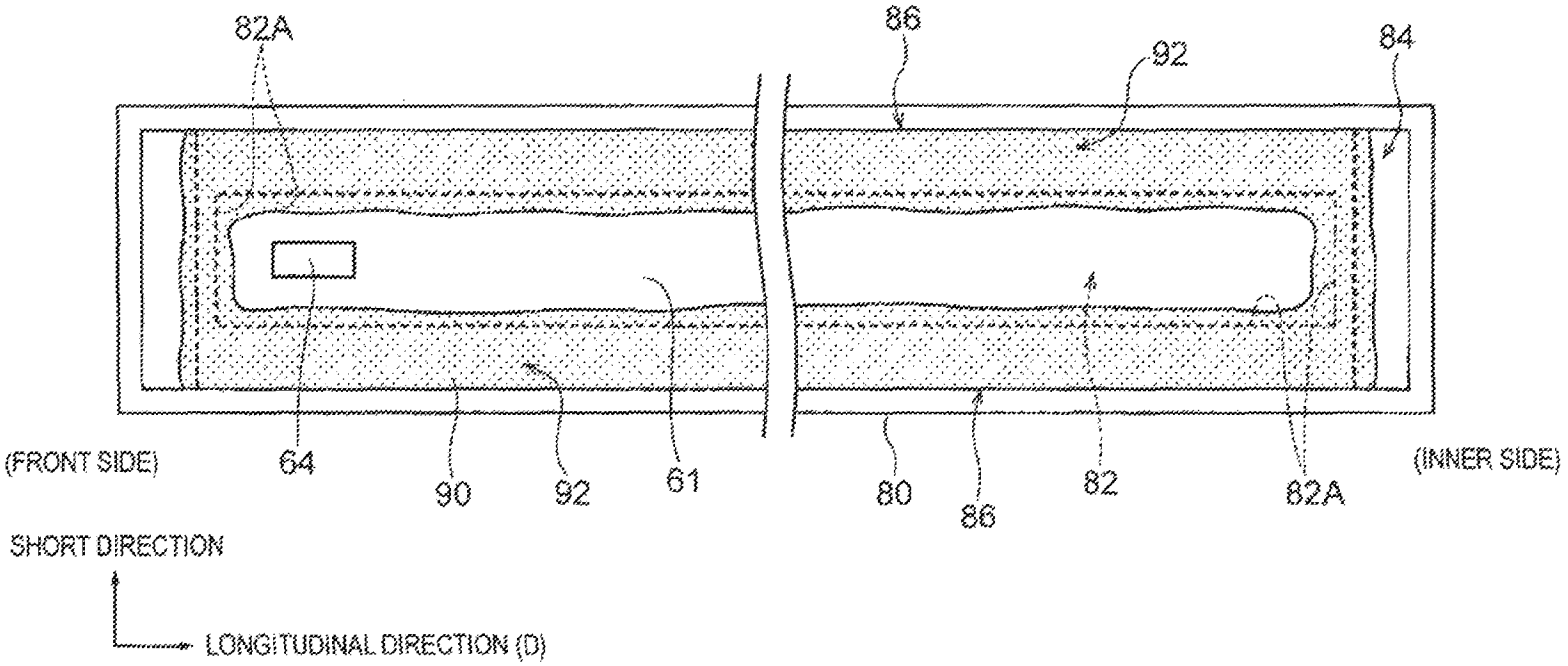
FIG. 7 is a schematic diagram (a bottom view) of the exposure apparatus according to the exemplary embodiment.

The elongated conductive layer 67 is formed between the substrate 61A at the first layer from a rear surface (a surface on a side opposite to a surface facing the photoreceptor 42) side of the substrate 61 and the substrate 61B at the second layer therefrom. As illustrated in FIG. 3, when viewed from a front surface side or the rear surface side of the substrate 61, outer extensions of the elongated conductive layer 67 are formed on outer sides of a portion on which all the LED arrays 62 on the front surface are mounted along a longitudinal direction of the substrate 61. Here, the conductive layer 67 functions to decrease noise with respect to the exposure apparatus 100 by being grounded to the casing of the image forming apparatus main body 10A. As illustrated in FIG. 7, on a front side in the longitudinal direction and at the middle in a short direction on the rear surface of the substrate 61 (the rear surface of the substrate 61A), a ground terminal 63 is formed. The elongated conductive layer 67 and the ground terminal 63 communicate with each other through the via 65 of the substrate 61A. The ground terminal 63 of the present exemplary embodiment is a pad (a copper foil) connected to the via 65.

[LED Array]

As illustrated in FIGS. 2, 3, 4, and 6, the plurality of LED arrays 62 are mounted on a front surface (a surface facing the photoreceptor 42) of the light emitting substrate 60. The plurality of LED arrays 62 are arranged in zigzags along the substrate 61 in the longitudinal direction on the front surface of the substrate 61. A plurality of LEDs 66 are arrayed along the substrate 61 in the longitudinal direction in each of the LED arrays 62.

[Conductive Component]

The conductive component 64 functions to be grounded to the casing of the image forming apparatus main body 10A.

As illustrated in FIGS. 4, 6, and 7, the conductive component 64 is a rectangular-parallelepiped conductive member. The conductive component 64 is mounted on the ground terminal 63 on an end surface out of a rear surface of the light emitting substrate 60. Therefore, as illustrated in FIG. 7, the conductive component 64 is arranged on the front side in the longitudinal direction and at the middle in the short direction on the rear surface of the light emitting substrate 60. The conductive component 64 has a height H1 which is the height from the rear surface of the light emitting substrate 60. In other words, in the conductive component 64, an end surface 64A on a side opposite to the end surface on the side which is bonded to the ground terminal 63 has the height H1 which is the height from the rear surface of the light emitting substrate 60.

A leaf spring (not illustrated) grounded to the casing is provided in the image forming apparatus main body 10A, and the end surface 64A is pressed by the leaf spring so that the conductive component 64 is grounded to the casing of the image forming apparatus main body 10A. In other words, in the present exemplary embodiment, the end surface 64A of the conductive component 64 functions as a ground terminal.

[Supplement to Light Emitting Substrate]

A plurality of terminals (not illustrated) are formed on the front surface of the substrate 61. The plurality of terminals are respectively wire-bonded to the above described plurality of LEDs 66. In addition to the above-described conductive component 64, a driver IC for applying a voltage to the LED array 62, and a connector for receiving a signal such as image data are mounted on the rear surface of the substrate 61.

[Lens Array]

The lens array 70 functions to focus light emitted from the plurality of LED arrays 62 onto the photoreceptor 42.

The elongated lens array 70 is SELFOC (registered trademark) lens array which is an aggregation of a plurality of rod lenses. As illustrated in FIG. 4, the lens array 70 is arranged between the light emitting substrate 60 (the substrate 61) and the photoreceptor 42 in the image forming apparatus 10.

[Casing]

As illustrated in FIGS. 2 and 4, the casing 80 functions to fix the light emitting substrate 60 (the substrate 61) and the lens array 70 so as to allow the front surface of the light emitting substrate 60 to face the lens array 70.

The elongated casing 80 is arranged so as to cause the longitudinal direction thereof to be along the photoreceptor 42 in an axial direction. An elongated penetration hole 82 facing the photoreceptor 42 is formed in the casing 80 along the photoreceptor 42 in the axial direction. On a side opposite to the side which is arranged on the photoreceptor 42 side in the casing 80, a hole 84 where the light emitting substrate 60 fits along the photoreceptor 42 in the axial direction is formed. Therefore, on the side opposite to the side which is arranged on the photoreceptor 42 side in the casing 80, step difference portions 86 are formed at both end portions of the casing 80 in the short direction.

The lens array 70 is fixed to the casing 80 by opening portion circumferential edges 82A on the photoreceptor 42 side in the elongated penetration hole 82 so as to cause the longitudinal direction of the lens array 70 to be along the image forming apparatus 10 in the apparatus depth direction. In this case, the lens array 70 is fixed to the casing 80 by an adhesive (not illustrated) which is applied to multiple places at the opening portion circumferential edges 82A on the photoreceptor 42 side.

As illustrated in FIGS. 4 and 7, in a state where the light emitting substrate 60 fits the hole 84, the light emitting substrate 60 is fixed to the casing 80. In this case, the light emitting substrate 60 is fixed to the casing 80 by an adhesive (not illustrated) which is applied to multiple places on an outer peripheral side in the front surface of the light emitting substrate 60. In the state where the light emitting substrate 60 fits the hole 84, the light emitting substrate 60 is fixed to the casing 80 in a state where the light emitting substrate 60 blocks an opening portion on the photoreceptor 42 and the opening portion on the opposite side so as to cause the longitudinal direction of the light emitting substrate 60 to be along the lens array 70 in the longitudinal direction.

[Sealing Material]

As illustrated in FIGS. 4 and 7, the sealing material 90 functions to seal a portion (hereinafter, referred to as the facing portion 92) where the step difference portion 86 of the casing 80 and a side surface of the light emitting substrate 60 face each other, from the rear surface side of the light emitting substrate 60. Therefore, the sealing material 90 prevents the light emitting substrate 60 from being intruded by impurities such as dust inside the image forming apparatus 10 from the rear surface side to the front surface side (into a space between facing surfaces where the light emitting substrate 60 and the lens array 70 face each other) through the facing portion 92. Here, the facing portion 92 is an example of a fitting portion.

As an example of a sealing material, the sealing material 90 of the present exemplary embodiment is formed by causing a liquefied sealing material (not illustrated) to react to moisture in the air so as to be hardened (solidified). The exposure apparatus 100 of the present exemplary embodiment is manufactured by applying the liquefied sealing material to entire regions on both end sides in the longitudinal direction and entire regions on both end sides in the short direction on the rear surface of the light emitting substrate 60. Therefore, the sealing material 90 of the present exemplary embodiment can have different shapes between a state of being a liquid immediately after application and a state of being hardened in the casing 80.

FIGS. 4 and 7 illustrate an example of a state where the liquefied sealing material is applied to the entire regions on both the end sides in the longitudinal direction and the entire regions on both the end sides in the short direction on the rear surface of the light emitting substrate 60, and is hardened thereat.

As illustrated in FIG. 4, the sealing material 90 on an upstream side in a rotational direction (the arrow direction) of the photoreceptor 42 out of the sealing material 90 included on both the end sides of the light emitting substrate 60 in the short direction has a height H2 (>height H1) which is a height from the rear surface of the light emitting substrate 60 at the end portion of the light emitting substrate 60 in the short direction. The height of the sealing material 90 gradually decreases from the end portion of the light emitting substrate 60 toward the conductive component 64 in the short direction, and configured an end portion of a height H4 (height H1>height H4≥0) at a position away from the conductive component 64. Moreover, the sealing material 90 on a downstream side in the rotational direction of the photoreceptor 42 out of the sealing material 90 included on both the end sides of the light emitting substrate 60 in the short direction has a height H3 (<height H1) which is a height from the rear surface of the light emitting substrate 60 at the end portion of the light emitting substrate 60 in the short direction. The height of the sealing material 90 gradually decreases from the end portion of the light emitting substrate 60 in the short direction toward the conductive component 64, and configures an end portion of a height H5 (height H1>height H5≥0) at a position away from the conductive component 64.

Figure 5:
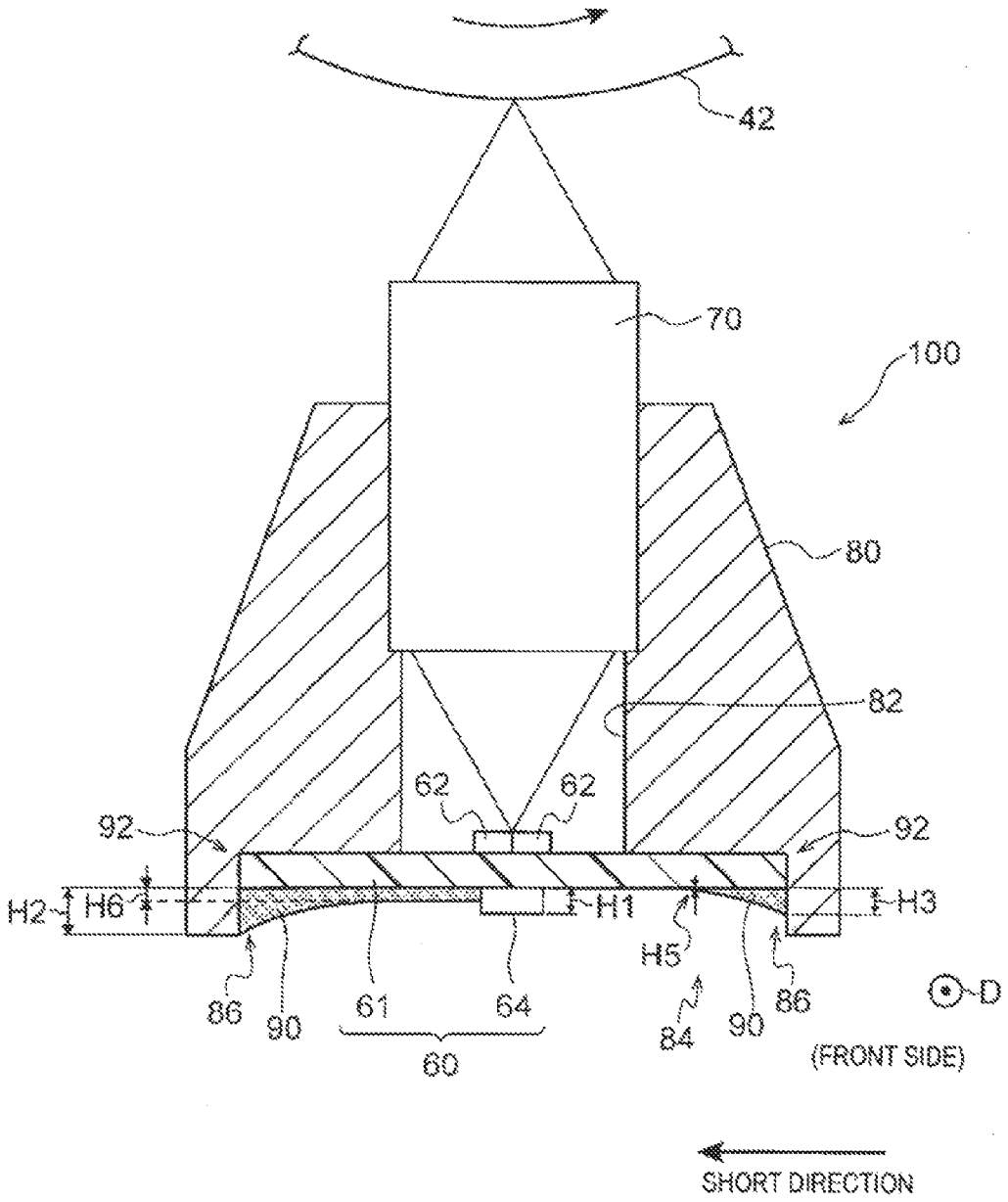
FIG. 5 is another schematic diagram (another front view) illustrating the relationship between the exposure apparatus and the photoreceptor configuring the image forming apparatus according to the exemplary embodiment.

FIG. 5 illustrates another example of a state where the liquefied sealing material is applied to the entire regions on both the end sides in the longitudinal direction and the entire regions on both the end sides in the short direction on the rear surface of the light emitting substrate 60, and is hardened thereat. In FIG. 5, the sealing material 90 on the upstream side in the rotational direction of the photoreceptor 42 out of the sealing material 90 applied on both the end sides of the light emitting substrate 60 in the short direction has the height which gradually decreases from the end portion of the light emitting substrate 60 in the short direction toward the conductive component 64, and configures an end portion by coming into contact with a side wall of the conductive component 64. The height of the end portion thereof configures a height H6 (height H6<height H1).

To sum up the above descriptions, the height H1 of the conductive component 64 from the rear surface of the light emitting substrate 60 is higher than the heights (height H4, height H5, and height H6) of the sealing material 90 from the rear surface of the light emitting substrate 60 at the end portion on the central portion side of the light emitting substrate 60. The sealing material 90 at the end portion on the central portion side of the light emitting substrate 60 denotes the end portion of the sealing material 90 on the conductive component 64 side.

<<Method of Manufacturing Exposure Apparatus>>

Next, descriptions will be given regarding the method of manufacturing an exposure apparatus 100, with reference to the drawings. The method of manufacturing an exposure apparatus 100 includes a first step, a second step, and a third step.

[First Step]

In the first step, the plurality of LED arrays 62 are mounted on the front surface of the substrate 61. The conductive component 64, the driver IC, the connector and the like are mounted on the rear surface of the substrate 61. Assembly of the light emitting substrate 60 is thereby performed.

Specifically, in the first step, the plurality of LED arrays 62 are arranged in zigzags on the front surface of the substrate 61 so as to cause the longitudinal direction of the LED arrays 62 to be along the substrate 61 in the longitudinal direction (refer to FIG. 2). In the first step, the conductive component 64 is mounted on the ground terminal 63 formed on the rear surface of the substrate 61 (refer to FIG. 7). Moreover, in the first step, the driver IC, the connector and the like are mounted on the rear surface of the substrate 61.

When the first step ends, preparation of the light emitting substrate 60 is completed.

[Second Step]

In the second step, as illustrated in FIG. 2, the light emitting substrate 60 and the lens array 70 are fixed to the casing 80 so as to cause the front surface of the light emitting substrate 60 and the lens array 70 to face each other.

Specifically, in the second step, the lens array 70 is fixed to the casing 80 by the adhesive which is applied to the multiple places at the opening portion circumferential edges on the photoreceptor 42 side in the elongated penetration hole so as to cause the longitudinal direction of the lens array 70 to be along the casing 80 in the longitudinal direction. Moreover, in the second step, the light emitting substrate 60 is fixed to the casing 80 by the adhesive which is applied to the multiple places on the front surface of the light emitting substrate 60 so as to cause the longitudinal direction of the light emitting substrate 60 to be along the lens array 70 in the longitudinal direction (refer to FIG. 2).

When the second step ends, the assembly of the aggregation (hereinafter, referred to as the aggregation) in which the light emitting substrate 60 and the lens array 70 are fixed to the casing 80 is thereby completed.

[Third Step]

In the third step, the facing portion 92 of the aggregation is sealed by the sealing material 90 from the rear surface side of the light emitting substrate 60.

Specifically, in the third step, the liquefied sealing material (not illustrated) is applied from the rear surface side of the light emitting substrate 60 so as to seal the facing portion 92 of the aggregation. Moreover, in the third step, the sealing material 90 is formed by causing the liquefied sealing material to react to moisture in the air so as to be hardened (solidified) (refer to FIG. 7). In this manner, the end portion of the sealing material 90 on the conductive component 64 side has the height of zero which is from the rear surface of the light emitting substrate 60 at a position away from the conductive component 64, thereby being hardened thereat (refer to FIG. 4). Even though the liquefied sealing material flows toward the side wall of the conductive component 64, the liquefied sealing material is hardened at the height H6 which does not exceed the height H1 of the conductive component 64 (refer to FIG. 5). The third step is carried out in a state where the rear surface of the light emitting substrate 60 faces upward.

When the third step ends, the exposure apparatus 100 is completed.

<<Operation>>

Next, descriptions will be given regarding operations of the exposure apparatus 100 and the image forming apparatus 10 according to the present exemplary embodiment with reference to the drawings. In the following descriptions, a comparison is performed between the present exemplary embodiment and a comparison embodiment which is described below as an assumption. In the following comparison embodiment, when components and the like used in the present exemplary embodiment are adopted, descriptions will be given while using the reference numerals and signs of the portions and the like as they are.

In the exposure apparatus of the comparison embodiment, the conductive component 64 is not mounted on the light emitting substrate configuring the exposure apparatus. The image forming apparatus of the comparison embodiment includes an exposure apparatus of the comparison embodiment. Other than these respects, the exposure apparatus and the image forming apparatus of the comparison embodiment have configurations similar to those in the exposure apparatus 100, the method of manufacturing an exposure apparatus 100, and the image forming apparatus 10 of the present exemplary embodiment.

In the method of manufacturing an exposure apparatus (hereinafter, referred to as the comparison method) of the comparison embodiment, the conductive component 64 is not mounted on the rear surface of the substrate 61 in the first step. Other than this respect, in the comparison method, a manufacturing step similar to the method of manufacturing an exposure apparatus 100 of the present exemplary embodiment is adopted.

Since the conductive component 64 is not mounted on the rear surface of the substrate 61 in the first step of the comparison method, the light emitting substrate having the uncovered ground terminal 63 is prepared. Subsequently, in the second step, the aggregation is assembled. Subsequently, in the third step, the liquefied sealing material is applied from the rear surface of the light emitting substrate having the uncovered ground terminal 63 so as to seal the facing portion 92 of the aggregation, and the liquefied sealing material is caused to react to moisture in the air so as to be hardened, thereby providing the sealing material 90 in the exposure apparatus of the comparison embodiment.

Incidentally, in the case of the comparison method, when the liquefied sealing material flows toward the ground terminal 63 side, there in a case where the liquefied sealing material is hardened in a state of covering the ground terminal 63.

In the state where the sealing material 90 covers the ground terminal 63 as described above, there is a possibility of an occurrence of a poor grounding effect in the exposure apparatus when the exposure apparatus is attached to the image forming apparatus main body 10A and pressed by the leaf spring provided in the image forming apparatus main body 10A. As a result, in the state where the sealing material 90 covers the ground terminal 63, there is a possibility of an occurrence of poor exposure in the exposure apparatus due to noise from other element components (for example, the electricity charging apparatus 44, the development apparatus 46, and the like) inside the image forming apparatus 10. Accordingly, there is a possibility of an occurrence of poor image forming performance in an image forming apparatus including the exposure apparatus in the state where the sealing material 90 covers the ground terminal 63. The aforementioned poor exposure denotes that an erroneous operation is caused in an output of the driver IC due to noise and the plurality of LEDs 66 configuring each of the LED arrays 62 which emit light not based on image data.

In the third step of the comparison method, when the liquefied sealing material is hardened before the liquefied sealing material flows over the ground terminal 63, the ground terminal 63 is not covered with the sealing material 90. However, in order to secure the aforementioned state in the third step, there is a need to perform sealing by reducing the amount per unit time of the liquefied sealing material applied to the end portion of the rear surface of the light emitting substrate so as not to allow the liquefied sealing material to flow over the ground terminal 63, thereby causing the time for the third step to be lengthened.

In contrast, according to the method of manufacturing an exposure apparatus 100 of the present exemplary embodiment, in the first step, the conductive component 64 is mounted on the ground terminal 63 on the rear surface of the substrate 61. Therefore, even though the liquefied sealing material reaches the conductive component 64, the end surface 64A of the conductive component 64 is not covered with the sealing material 90 as long as the height of the liquefied sealing material is lower than the height H1 when the liquefied sealing material flows toward the conductive component 64.

Therefore, in the exposure apparatus 100 of the present exemplary embodiment, compared to the exposure apparatus of the comparison embodiment, even in the state where the sealing material 90 flows toward the central portion side of the light emitting substrate 60 and is solidified thereat, the end surface 64A is prevented from being covered with the sealing material 90. Accordingly, compared to the image forming apparatus of the comparison embodiment, the image forming apparatus 10 of the present exemplary embodiment is prevented from causing the poor image forming performance due to the poor grounding effect of the exposure apparatus 100 and the image forming apparatus main body 10A.

The exposure apparatus 100 of the present exemplary embodiment includes the conductive component 64. Therefore, according to the method of manufacturing an exposure apparatus 100 of the present exemplary embodiment, compared to the third step of the comparison method, even though the amount per unit time of the liquefied sealing material applied to the end portion of the rear surface of the light emitting substrate is increased, the end surface 64A of the conductive component 64 is unlikely to be covered with the sealing material 90.

Therefore, in the method of manufacturing an exposure apparatus 100 of the present exemplary embodiment, compared to the comparison method, productivity of the exposure apparatus 100 is improved.

As above, the present invention has been described in detail with reference to the specific exemplary embodiment, the present invention is not limited to the exemplary embodiment described above, and other exemplary embodiments can be adopted within a scope of technical thoughts of the present invention.

For example, in the descriptions of the present exemplary embodiment, the plurality of LED arrays 62 are arranged in zigzags along the substrate 61 in the longitudinal direction on the front surface of the substrate 61. However, the arrangement does not need to be in zigzags as long as the plurality of LED arrays 62 are arranged along the substrate 61 in the longitudinal direction.

As an example, in the descriptions of the sealing material 90 of the present exemplary embodiment, the liquefied sealing material is a material (a resin) caused to react to moisture in the air so as to be hardened (solidified). However, in the third step, as long as the sealing material is a fluid such as a liquid before being hardened and is a solid after being hardened, the liquefied sealing material does not need to be a resin reacting to moisture in the air so as to be hardened. For example, a ultraviolet curing resin, a thermosetting resin, an inorganic adhesive, an organic adhesive, and the like may be adopted as the sealing material 90.

In the descriptions of the present exemplary embodiment, the exposure apparatus 100 is completed when the third step ends. However, the exposure apparatus 100 may be completed including other steps in addition to the first step, the second step, and the third step of the present exemplary embodiment. For example, an inspection step for the exposure apparatus 100 may be provided after the third step, thereby completing the exposure apparatus 300.

In the descriptions of the present exemplary embodiment, the transfer unit 50 is adopted as an example of the transfer apparatus, and the medium P is adopted as an example of the transfer object. However, when focusing on the primary transfer roll 54 and the transfer belt 52, it is possible to consider the primary transfer roll 54 as an example of the transfer apparatus and the transfer belt 52 as an example of the transfer object.

What is claimed is:

1. An exposure apparatus comprising:

a substrate that has a light emitting element mounted on a front surface of the substrate;

a casing to which the substrate and an optical element are fixed so as to allow the substrate to face the optical element that focuses light emitted from the light emitting element;

a sealing material that seals a fitting portion between the substrate and the casing from a rear surface side of the substrate; and a conductive component that is mounted on a ground terminal formed on the rear surface of the substrate and has a height from the rear surface higher than a height of the sealing material at an end portion of the sealing material on a central portion side of the substrate;

the sealing material having a height from the rear surface that gradually decreases from an end portion of the substrate toward the conductive component in a short direction of the substrate.

2. An image forming apparatus comprising:

an image carrier;

an electricity charging apparatus that electrically charges the image carrier;

the exposure apparatus according to claim 1 of which the conductive component is grounded to a main body of the image forming apparatus and that forms a latent image on the image carrier electrically charged by the electricity charging apparatus;

a development apparatus that develops the latent image as a toner image; and a transfer apparatus that transfers the toner image to a transfer object.

3. The exposure apparatus according to claim 1, wherein the end portion of the sealing material is configured at a position away from the conductive component.

4. The exposure apparatus according to claim 1, wherein the height of the sealing material at one end portion of the substrate in the short direction is higher than the height of the sealing material at the other end portion of the substrate in the short direction.

5. The exposure apparatus according to claim 1, wherein the end portion of the sealing material comes into contact with a side wall of the conductive component.

6. A method of manufacturing an exposure apparatus, comprising, in the following order:

mounting a light emitting element on a front surface of a substrate and mounting a conductive component on a ground terminal formed on a rear surface of the substrate;

fixing the substrate and an optical element to a casing so as to allow the front surface of the substrate to face the optical element that images light emitted from the light emitting element; and sealing a fitting portion between the substrate and the casing from a rear surface side of the substrate with a sealing material, the sealing material having a height from the rear surface that gradually decreases from an end portion of the substrate toward the conductive component in a short direction of the substrate, and the conductive component having a height from the rear surface higher than a height of the sealing material at an end portion of the sealing material on a central portion side of the substrate.

* * * * *